US005727789A

United States Patent [19]

Butts

[11] Patent Number: 5,727,789

[45] Date of Patent: Mar. 17, 1998

[54] ARROW LOCATION APPARATUS

[75] Inventor: Russell T. Butts, Burlington, Conn.

[73] Assignee: JDR, Inc., Burlington, Conn.

[21] Appl. No.: 267,065

[22] Filed: Jun. 27, 1994

[51] Int. Cl.[6] ..... G06F 15/44

[52] U.S. Cl. ..... 273/371

[58] Field of Search ..... 273/348, 371, 273/373, 377, 378, 379

[56] References Cited

U.S. PATENT DOCUMENTS

| | | | |
|---|---|---|---|
| 3,229,976 | 1/1966 | Tompkins et al. | 273/371 X |
| 4,415,162 | 11/1983 | Sheppard | 273/371 |
| 4,763,903 | 8/1988 | Goodwin et al. | 273/371 |
| 4,789,932 | 12/1988 | Cutler et al. | 273/371 X |
| 5,259,625 | 11/1993 | Fanning | 273/371 X |
| 5,314,195 | 5/1994 | Schulze | 273/371 |
| 5,358,253 | 10/1994 | Chen | 273/371 X |
| 5,366,230 | 11/1994 | Sanquinetti-Trigo | 273/371 |

FOREIGN PATENT DOCUMENTS

| | | | |
|---|---|---|---|
| 2677746 | 12/1992 | France | 273/371 |
| 9411696 | 5/1994 | WIPO | 273/371 |

*Primary Examiner*—William E. Stoll
*Attorney, Agent, or Firm*—Robert S. Smith

[57] ABSTRACT

In one form of the invention an apparatus for precisely locating an associated arrow embedded in an associated target having a first center which includes a plurality of light sources disposed in an arc having a second center and a plurality of photo sensors arrayed opposite the light sources with the target intermediate the light sources and photo sensors. The apparatus includes a apparatus for turning on and off the light sources sequentially to produce a scan of the target, apparatus for determining the exact location of the arrow embedded in the target with the apparatus for determining utilizing the apparatus for detecting. In another form of the invention an apparatus for precisely locating an associated arrow embedded in an associated target having a first center which includes a plurality of corner cube reflectors disposed having a second center with the plurality of corner cube reflectors being arrayed generally around a first side of the target. The apparatus includes a light detection and transmitting module disposed on the side of the target which is generally opposite the plurality of corner cube reflectors and generates and receives pulses of light after the light has been reflected off one of the plurality of corner cube reflectors. The apparatus includes apparatus for determining the exact location of an arrow embedded in the target.

13 Claims, 17 Drawing Sheets

FIG 4

DEFINITION OF ARC SEGMENT: $K = E * P$

WHERE: $E$ = WIDTH OF LED / RADIUS OF ARC (IN RADIANS)

$P$ = ID NUMBER OF LED (0 TO 511)

$\pi = 3.14159265$ $2 * \pi$ RADIANS = 360 DEGREES

ANGLE $X = [\ \mathrm{ARCTAN}\ ((R * \mathrm{SIN}\ K) + A + D)/R * \mathrm{COS}\ K\ ] - \pi/4$
(AT SENSOR B)

$$\text{ANGLE } Y = \mathrm{ARCTAN}\ \left|\frac{B - R * \mathrm{COS}\ K}{A + R * \mathrm{SIN}\ K}\right|$$

(AT SENSOR A)

$$\text{ANGLE } Z = \mathrm{ARCTAN}\ \left|\frac{A + R * \mathrm{SIN}\ K}{C + R * \mathrm{COS}\ K}\right|$$

(AT SENSOR C)

X COORDINATES:

$X1 = [((C * \mathrm{TAN}\ Z) + D) / (\mathrm{TAN}\ (X + \pi/4) - \mathrm{TAN}\ Z)\ ]$ $X2 = [((D * \mathrm{TAN}\ Y) + B) / (1 + \mathrm{TAN}\ Y) * \mathrm{TAN}\ (X + \pi/4)))]$ $X3 = -\ [\ (C * \mathrm{TAN}\ X * \mathrm{TAN}\ Y) - B / 1 + (\mathrm{TAN}\ Z * \mathrm{TAN}\ Y)\ ]$

X AVERAGE: $X7 = [\ (X1 + X2 + X3) / 3\ ]$

Y COORDINATES:

$Y1 = [\ (B - X1) / \mathrm{TAN}\ Y\ ] - A$ $Y2 = (\ C * \mathrm{TAN}\ Z) + (X2 * \mathrm{TAN}\ Z) - A$ $Y3 = [\ (B - X3) / \mathrm{TAN}\ Y\ ] - A$

Y AVERAGE: $Y4 = [\ (Y1 + Y2 + Y3) / 3\ ]$

CONVERT X - Y COORDINATES INTO POLAR COORDINATES:

$$V7 = ((X*X)+(Y*Y))^{.5} = ((X7*X7)+(Y7*Y7))^{.5}$$

$$V7 = ((X7*X7)+((Y4-F)*(Y4-F)))^{.5}$$

$$G = | \text{ ARCTAN } Y7/X7 |$$

TRANSLATE Y COORDINATES FROM SYMMETRICAL CENTER OF ARC OF LED's TO SYMMETRICAL CENTER OF TARGET:

$$Y_7 = Y_4 - F$$

FIG 7A

```
1 REM SENSOR LOCATION DIMENS.
2 A=9.6875
3 F=2.3750
4 B=10.4375
5 D=1.6875
6 PRINT 'INPUT P (LED NO. FROM SENSOR B)'
7 E=.006135923
8 INPUT P
10 R=11.5625
20 K=E*P
30 M=(A+D+(R*SIN(K)))/(R*COS(K))
35 REM ANGLE AT SENSOR B IN TERMS OF LED NO.
40 Q=ATN(M)
45 X=Q-(3.14159265/4)
50 PRINT 'INPUT S (LED NO, FROM SENSOR A)'
60 INPUT S
70 K=E*S
80 N=(B -(R*COS(K)))/(A+(R*SIN(K)))
85 REM ANGLE AT SENSOR A IN TERMS OF LED NO.
90 Y=ABS(ATN(N))
100 PRINT 'INPUT T (LED NO. FROM SENSOR C)'
110 INPUT T
120 K=E*T
130 O=(A+(R*SIN(K)))/(B+(R*COS(K)))
135 REM ANGLE AT SENSOR C IN TERMS OF LED NO.
140 Z=ABS(ATN(O))
145 REM X CO-ORDS OF DART
150 I=((B*TAN(Z))+D)
160 J=(TAN(X+(3.141592635/4)))-TAN(Z)
170 X1=I/J
190
X2=((D*TAN(Y))+B)/(1+(TAN(Y)*TAN(X+(3.14159265/4))
))
230 X3=-((B*TAN(Y)*TAN(Z))-B)/(1+(TAN(Y)*TAN(Z)))
280 REM Y CO-ORDS OF DART
290 Y1=((B-X1)/TAN(Y))-A
300 Y2=(B*TAN(Z))+(TAN(Z)*X2)-A
310 Y3=((B-X3)/TAN(Y))-A
313 REM TRANSFORM Y CO-ORDS TO TARGET CENTER
320 Y4=Y1-F
```

FIG 7B

```
330 Y5=Y2-F
340 Y6=Y3-F
345 REM AVERAGE X & Y CO-ORDS
350 X7=(X1+X2+X3)/3
360 Y7=(Y4+Y5+Y6)/3
361 REM CONVERT INTO POLAR FORM
362 V7=((Y7^2)+(X7^2))^.5
363 G6=ABS(ATN(Y7/X7))
364 REM ASSIGN SIGN TO ANGLEŠ365 IF Y7>0 AND X7<0
THEN
G6=(3.14159265-G6)
366 IF Y7<0 AND X7>0 THEN G6=-G6
367 IF Y7<0 AND X7<0 THEN G6=(-3.14159265+G6)
368 G7=G6*(180/3.14159265)
369 PRINT 'POLAR FORM'
370 PRINT V7;'INCH,';G7;'DEGREE'
400 REM SCORE LOOKUP TABLE
405 H=0:U=0:W=0
410 IF V7<.250 THEN H=25:W=2:GOTO 680
420 IF V7>.250 AND V7<.625 THEN H=25:W=1:GOTO 680
430 IF G7>-9 AND G7<9 THEN H=6:GOTO 630
435 IF G7>9 AND G7<27 THEN H=10:GOTO 630
440 IF G7>27 AND G7<45 THEN H=15:GOTO 630
450 IF G7>45 AND G7<63 THEN H=2:GOTO 630
460 IF G7>63 AND G7<81THEN H=17:GOTO 630
470 IF G7>81 AND G7<99 THEN H=3:GOTO 630
480 IF G7>99 AND G7<117 THEN H=19:GOTO 630
490 IF G7>117 AND G7<135 THEN H=7:GOTO 630
500 IF G7>135 AND G7<153 THEN H=16:GOTO 630
510  IF G7>153 AND G7<171 THEN H=8:GOTO 630
520  IF G7>171 AND G7<188 THEN H=11:GOTO 630
530  IF G7<-9 AND G7>-27 THEN H=13:GOTO 630
540  IF G7<-27 AND G7>-45 THEN H=4:GOTO 630
550 IF G7<-45 AND G7>-63 THEN H=18:GOTO 630
560 IF G7<63 AND G7>-81 THEN H=1:GOTO 630
570 IF G7<-81 AND G7>-99 THEN H=20:GOTO 630
580 IF G7<-99 AND G7>-117 THEN H=5:GOTO 630
590 IF G7<-117 AND G7>-135 THEN H=12:GOTO 630
```

FIG 7C

```
600 IF G7<-135 AND G7>-153 THEN H=9:GOTO 630
610 IF G7<-153 AND G7>-171 THEN H=14:GOTO 630
620 If  G7 <-171 AND G7>-180 THEN H=11:GOTO 630
630 IF V7>.625 AND V7<3.75 THEN W=1:GOTO 680
640 IF V7>3.75 AND V7<4.125 THEN W=3:GOTO 680
650 IF V7>4.125 AND V7<6.25 THEN W=1:GOTO 680
655 IF V7>6.25 AND V7<6.625 THEN W=2:GOTO 680
670 IF V7>6.625 THEN W=0
680 U=H*W
690 PRINT 'SCORE=';H;' * MULT';W; '=' ; U
```

FIG 12A

```
1 REM SENSOR LOCATION DIMENS.
2 A=15.8750
3 F=2.3750
4 B=7
5 D=-3.50
6 PRINT 'INPUT P (LED NO. FROM SENSOR B)'
7 E=.006135923
8 INPUT P
10 R=11.5625
20 K=E*P
30 M=(A+D+(R*SIN(K)))/(R*COS(K))
35 REM ANGLE AT SENSOR B IN TERMS OF LED NO.
40 Q=ATN(M)
45 X=Q-(3.14159265/4)
50 PRINT 'INPUT S (LED NO, FROM SENSOR A)'
60 INPUT S
70 K=E*S
80 N=(B -(R*COS(K)))/(A+(R*SIN(K)))
85 REM ANGLE AT SENSOR A IN TERMS OF LED NO.
90 Y=ABS(ATN(N))
100 PRINT 'INPUT T (LED NO. FROM SENSOR C)'
110 INPUT T
120 K=E*T
130 O=(A+(R*SIN(K)))/(B+(R*COS(K)))
135 REM ANGLE AT SENSOR C IN TERMS OF LED NO.
140 Z=ABS(ATN(O))
145 REM X CO-ORDS OF DART
150 I=((B*TAN(Z))+D)
160 J=(TAN(X+(3.141592635/4)))-TAN(Z)
170 X1=I/J
190((D*TAN(Y))+B)X2=/(1+(TAN(Y)*TAN
(X+(3.14159265/4))
230 X3=-((B*TAN(Y)*TAN(Z))-B)/(1+(TAN(Y)*TAN(Z)))
280 REM Y CO-ORDS OF DART
290 Y1=((B-X1)/TAN(Y))-A
300 Y2=(B*TAN(Z))+(TAN(Z)*X2)-A
310 Y3=((B-X3)/TAN(Y))-A
313 REM TRANSFORM Y CO-ORDS TO TARGET CENTER
320 Y4=Y1-F
```

FIG 12B

```
330 Y5=Y2-F
340 Y6=Y3-F
345 REM AVERAGE X & Y CO-ORDS
350 X7=(X1+X2+X3)/3
360 Y7=(Y4+Y5+Y6)/3
361 REM CONVERT INTO POLAR FORM
362 V7=((Y7^2)+(X7^2)^.5
363 G6=ABS(ATN(Y7/X7))
364 REM ASSIGN SIGN TO ANGLE
365 IF Y7>0 AND X7<0 THEN G6=(3.14159265-G6)
366 IF Y7<0 AND X7>0 THEN G6=-G6Š367 IF Y7<0 AND
X7<0 THEN G6=(-3.14159265+G6)
368 G7=G6*(180/3.14159265)
369 PRINT 'POLAR FORM'
370 PRINT V7;'INCH,';G7;'DEGREE'
400 REM SCORE LOOKUP TABLE
405 H=0:U=0:W=0
410 IF V7<.250 THEN H=25:W=2:GOTO 680
420 IF V7>.250 AND V7<.625 THEN H=25:W=1:GOTO 680
430 IF G7>-9 AND G7<9 THEN H=6:GOTO 630
435 IF G7>9 AND G7<27 THEN H=10:GOTO 630
440 IF G7>27 AND G7<45 THEN H=15:GOTO 630
450 IF G7>45 AND G7<63 THEN H=2:GOTO 630
460 IF G7>63 AND G7<81THEN H=17:GOTO 630
470 IF G7>81 AND G7<99 THEN H=3:GOTO 630
480 IF G7>99 AND G7<117 THEN H=19:GOTO 630
490 IF G7>117 AND G7<135 THEN H=7:GOTO 630
500 IF G7>135 AND G7<153 THEN H=16:GOTO 630
510 IF G7>153 AND G7<171 THEN H=8:GOTO 630
520 IF G7>171 AND G7<188 THEN H=11:GOTO 630
530 IF G7<-9 AND G7>-27 THEN H=13:GOTO 630
540 IF G7<-27 AND G7>-45 THEN H=4:GOTO 630
550 IF G7<-45 AND G7>-63 THEN H=18:GOTO 630
560 IF G7<63 AND G7>-81 THEN H=1:GOTO 630
570 IF G7<-81 AND G7>-99 THEN H=20:GOTO 630
580 IF G7<-99 AND G7>-117 THEN H=5:GOTO 630
590 IF G7<-117 AND G7>-135 THEN H=12:GOTO 630
600 IF G7<-135 AND G7>-153 THEN H=9:GOTO 630
610 IF G7<-153 AND G7>-171 THEN H=14:GOTO 630
620 If  G7 <-171 AND G7>-180 THEN H=11:GOTO 630
```

FIG 12C

```
630 IF V7>.625 AND V7<3.75 THEN W=1:GOTO 680
640 IF V7>3.75 AND V7<4.125 THEN W=3:GOTO 680
650 IF V7>4.125 AND V7<6.25 THEN W=1:GOTO 680
655 IF V7>6.25 AND V7<6.625 THEN W=2:GOTO 680
670 IF V7>6.625 THEN W=0
680 U=H*W
690 PRINT 'SCORE=';H;' * MULT';W; '=' ; U
```

FIG 13

Definition of Arc Segment:

K = E * P (Fig.2 Embodiment)

K = E * (L-P) (Fig.8 Embodiment)

WHERE: E = WIDTH OF LED/RADIUS OF ARC(IN RADIANS)
P = ID NUMBER OF LED (0 TO 511)
L = MAXIMUM QUANTITY OF LEDs MONITORED
$\pi$ = 3.14159265
2 * $\pi$ RADIANS = 360 DEGREES

ANGLE X =[ ARCTAN(( R * SIN K )+ A + D)/R * COS K ]-$\pi$/4
(AT SENSOR B)

$$\text{ANGLE Y} = \text{ARCTAN}\left|\frac{B - R * \cos K}{A + R * \sin K}\right|$$

(AT SENSOR A)

$$\text{ANGLE Z} = \text{ARCTAN}\left|\frac{A + R * \sin K}{C + R * \cos K}\right|$$

(AT SENSOR C)

X COORDINATES:

$X_1$ = [((C * TAN Z)+ D)/(TAN (X + $\pi$/4)- TAN Z]

$X_2$ = [((D * TAN Y)+ B)/(1 + TAN Y)* TAN (X + $\pi$/4)))]

$X_3$ = - [( C * TAN X * TAN Y)-B / 1 + (TAN Z * TAN Y)]

X AVERAGE: $X_7$ = [ ($X_1$ + $X_2$ + $X_3$) / 3 ]

Y COORDINATES:

$Y_1$ = [ (B - $X_1$) / TAN Y ] - A $Y_2$ = ( C * TAN Z) + ($X_2$ * TAN Z) - A $Y_3$ = [ (B - $X_3$) / TAN Y ] - A

Y AVERAGE: $Y_4$ = [ ($Y_1$ + $Y_2$ + $Y_3$) / 3 ]

ARROW LOCATION APPARATUS

BACKGROUND OF THE INVENTION

The invention relates to an apparatus to precisely locate an arrow embedded in a target, such as a dart in a game of darts.

Dart games are popular in England and are gaining in popularity in the United States. Traditionally, after an arrow or dart has been thrown into the target, a person has to visually inspect the target to determine where the arrow landed. That person has to then calculate the score according to the rules of the game being played. The applications for such devices include use in places of entertainment and in dart leagues and dart tournaments.

The prior art includes complex apparatus used for diversified purposes:

The apparatus shown in U.S. Pat. No. 4,845,346 Touch Panel Having Parallax Compensation and Intermediate Coordinate Determination uses light sources and light receiving elements in sequentially driven pairs to accomplish a scan operation, and uses an interrupted signal to determine position.

U.S. Pat. No. 4,187,545 Article Orientation Determining Apparatus employs a column of sequentially pulsed radiation emitters and corresponding detectors and develops binary data indicative of the number of emitters that are unblocked during each scan.

U.S. Pat. No. 4,243,877 Electro-Optical Target For An Electro-Optical Alignment Measuring System describes a reflective target that includes a photoelectric sensor for producing an electric signal indicative of the lateral displacement of the reflective target and a reflective surface (mirror) for returning a portion of the optical reference beam to a photo sensor positioned adjacent the reference beam source to provide information relative to the angular position of the reflective target.

U.S. Pat. No. 4,346,994 Secondary Alignment Target For An Electro-Optical Alignment Measuring System employs a beam splitter in which the refracted sub-portion furnishes optical information regarding transverse orientation of the target, while the reflected sub-portion is re-reflected by the beam splitter to furnish a return beam containing optical information regarding rotational orientation of the target.

The apparatus shown in U.S. Pat. No. 4,052,066 Light-Emission Gun Amusement Machine For Home Use comprises of a light source, screen, and mirror as disposed between the screen and light source.

The apparatus shown in U.S. Pat. No. 4,281,926 Method and Means For Analyzing Sphero-Cylindrical Optical Systems utilizes a beam splitter and mirror for finding the refractive properties of lenses.

The apparatus shown in U.S. Pat. No. 5,154,404 Jam Detector For Inserter utilizes horizontal and vertical photo sensors and associated retro-reflective targets to detect jams by sensing an interruption of the horizontal beam and an uninterrupted retro-reflection of the vertical beam.

U.S. Pat. No. 5,154,002 Probe, Motion Guiding Device, Position Sensing Apparatus, and Position Sensing Method has a differential optical transducer which has two light source elements which emit light beams and two light sensor elements which receive these beams and a electronic circuit that compares the signal from light sensor elements and provides an output signal which indicates the position of the second member relative to the first member.

The apparatus shown in U.S. Pat. No. 3,877,816 Remote-Angle-of-Rotation Measurement Device Using Light Modulation and Electro-Optical Sensors includes a rotating disc-type linear polarizer in combination with a reference linear polarizer and a target linear polarizer. The photo sensors are arranged to receive modulated light separately from the target and reference polarizer and sinusoidal output signals representative of the modulated light received by the photo sensors are generated.

While such apparatus are suitable for some applications, they are not wholly satisfactory. The noted patented inventions apply to a myriad of diverse inventions, having only a casual relationship to the present apparatus.

It is an object of the invention to provide apparatus to precisely locate an arrow in a target.

It is an object of the invention to display the score of a dart game.

Another object of the invention is to provide apparatus that will function with a standard, unmodified bristle board target and standard unmodified darts.

Still another object of the invention is to be able to program different game rules into the apparatus and to calculate the score.

It is yet another object of the present invention to provide apparatus that is reliable.

It is an object of the invention to provide apparatus which is inexpensive to manufacture.

It is also an object of the invention to enable the apparatus to be used with targets of various diameters.

SUMMARY OF THE INVENTION

It has now been found that these and other objects of the invention may be attained in an apparatus for precisely locating an associated arrow embedded in an associated target having a first center which includes a plurality of light sources positioned in an arc having a second center. The first center may be offset 2.375 inches from the second center, which was empirically derived. A plurality of photo sensors are arrayed opposite the light sources with the target intermediate the light sources and photo sensors. The apparatus includes a means for turning on and off each light source sequentially to produce a scan of the target. The apparatus also includes a means for detecting when an arrow embedded in the target interrupts any light beam from any of the light sources to any of the photo sensors and a means for determining the exact location of an arrow embedded in the target, the means for determining utilizing the means for detecting.

In some forms of the invention, a plurality of photo sensors comprises three photo sensors and the means for determining the arrow's location includes a multiplexer and the multiplexer controls the scan of the light sources. The multiplexer may be controlled by a microprocessor which turns the light sources on in sequence so that only one light source's light is projected across the target to the photo sensors. The photo sensors may be located in relation to the target and the light sources so that the photo sensors' cones of operation have azimuth angles of approximately 60 degrees each and the azimuth angles overlap in order to receive the beam of light from any light source. In some forms of the invention, the microprocessor receives the output signals from the photo sensors and performs the required mathematical functions to calculate the location coordinates. The apparatus' microprocessor may be connected to a Read Only Memory (ROM) in which the rules of the game being played can be programmed and the score calculated according to the game rules programmed into the ROM. The microprocessor may display the score on a display. In some forms of the invention, the light sources are light emitting diodes (LEDs). The number of LEDs in the arcuate array may be 512. The LEDs may be rectangular in shape with one side being the actual emitter, emitting light in approximately 120 degrees of azimuth angle. The photo sensors and plurality of LEDs may be covered by an optional light shield. The arcuate array of light sources may have an angular sector of 177.6 degrees and a radius of 11.562 inches.

The apparatus may include a multiplexer that controls the scan of the LEDs. In some forms of the invention, the multiplexer is controlled by a microprocessor which turns the LEDs on in sequence so that only one of the LEDs' light is projected across the target's face to the photo sensors. The apparatus may include a microprocessor that receives the output signal from the photo sensors and performs the required mathematical functions to calculate the location coordinates for the arrow, and display the score on the apparatus' display.

It has also been found that these and other objects of the invention may also be attained in another form of the apparatus for precisely locating an arrow embedded in an associated target having a first center. The apparatus includes a plurality of corner cube reflectors arrayed in semi-circle having a second center with the plurality of corner cube reflectors being arrayed generally around a first side of the target. The apparatus includes a light detection and transmitting module which is disposed on a side of the target generally opposite the plurality of corner cube reflectors with the light detection and transmitting module generating pulses of light and receiving the pulses of light after the light has been reflected off one of the plurality of corner cube reflectors. The first and second mirrors of the apparatus are positioned generally opposite to the first side and respectively on each side of the light detection and transmitting module with the mirrors disposed to reflect light beams originating from the light detection and transmitting module to cause light pulses to scan across the entire face of the target. The apparatus includes a means for determining when an arrow embedded in the target interrupts a light pulse emitted from the light detection and transmitting module and a means for determining the exact location of an arrow embedded in the target. In some forms of the invention, the light detection and transmitting module includes a light source, a fixed half prism which functions as a beam splitter, a motor with a reflector mounted on the motor's rotating shaft, a photo sensor, a light shield, and two lenses. The light source of the light detection and transmitting module may be a semi-conductor diode laser with a power rating of approximately three milliwatts. The light source may produce an output waveform in the form of a repetitious rectangular wave. In some forms of the invention, the microprocessor generates a train of rectangular pulses, each rectangular pulse accurately timed and electronically identified, which alternately turn the laser on and off. Simultaneously, the motor's rotating shaft causes the light path to scan across the target. The motor rotation is synchronized with the laser pulse train such that the light pulses which are accurately generated are closely and equally spaced in a radial pattern encompassing the entire target face.

In some forms of the invention, the microprocessor contains digital circuits which process the rectangular waveforms received by the photo sensor, perform the required mathematical functions and produce location coordinates for each arrow. The digital circuits may contain a Read Only Memory (ROM) in which the rules of the game being played can be programmed and the game score calculated according to the programmed game rules. A microprocessor may be connected to a display with the display used to show the score of the game being played. The arcuate array of plurality of corner cube reflectors may have an angular sector of 177.6 degrees and a radius of 11.562 inches.

BRIEF DESCRIPTION OF THE DRAWING

The invention will be better understood by reference to the accompanying drawing in which:

FIG. 4 and 4A are the mathematical definitions and relationships used to precisely locate an arrow embedded in the target together with a diagrammatic view in FIG. 4A.

FIG. 6 includes equations used to translate the coordinates of the arrow to the symmetrical center of the target.

FIGS. 7A, 7B, and 7C are sequentially parts of the computer program listing which shows the mathematical calculations necessary to precisely locate the arrow in the target in the first embodiment.

FIGS. 12A, 12B and 12C are sequential parts of FIG. 12 which is a portion of the computer program listing which shows the mathematical calculations necessary to precisely locate the arrow in the target in the second embodiment.

FIG. 13 is the mathematical definitions and relationships used to precisely locate an arrow embedded in the target in the second embodiment.

DESCRIPTION OF THE PREFERRED EMBODIMENT

Figure 1B:
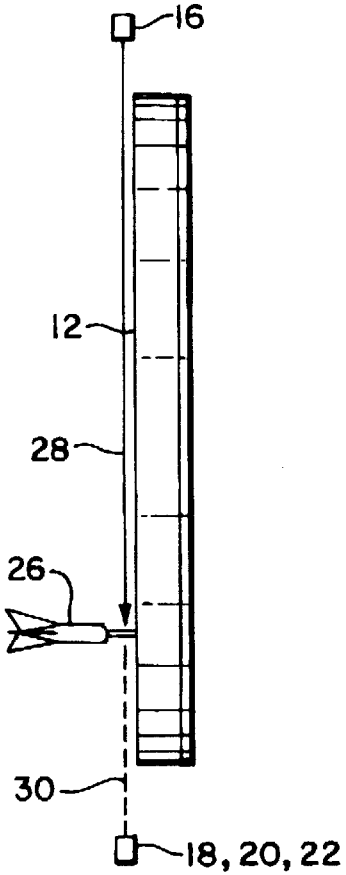
FIGS. 1A and 1B are respectively top view and side elevational view of the relationship between a single light source, an arrow, and a single photo sensor in a first embodiment.
Figure 1A:
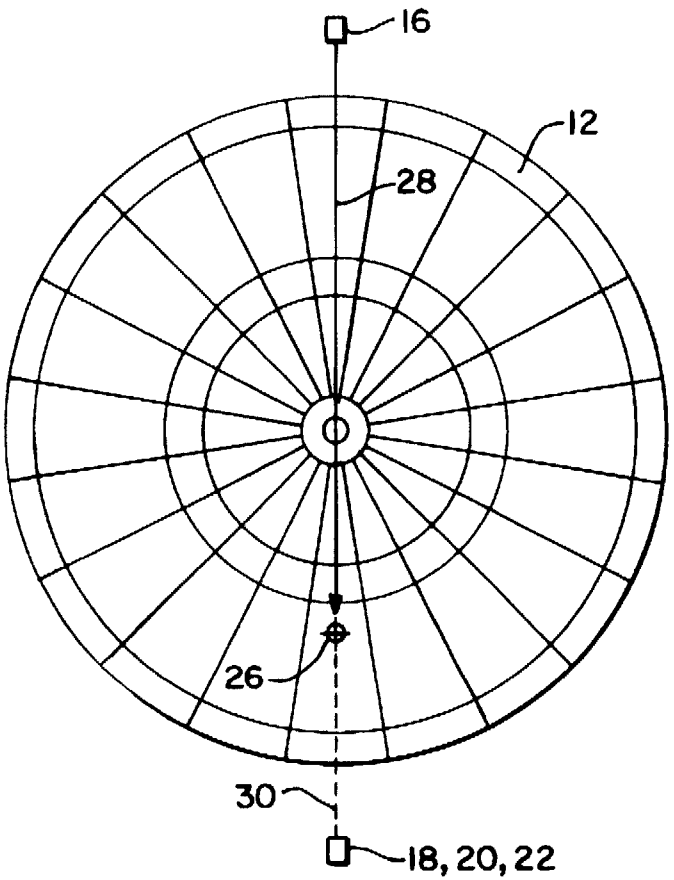

Referring now to FIGS. 1–5 there is shown a preferred form of the detection apparatus 10 for precisely locating an associated arrow 26 in an associated target 12. The apparatus 10 includes an arcuate array 14 of light sources, and photo sensors 18, 20 and 22. The apparatus is shown in greatest detail in FIGS. 1–2 and the means for precisely locating an associated arrow 26 in associated target 12 is shown in FIGS. 3–7.

Figure 2B:
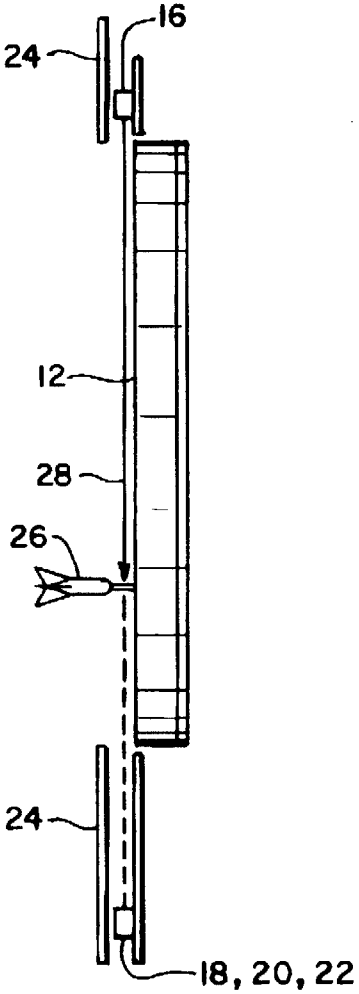
FIGS. 2A and 2B are respectively top and side elevational views of the apparatus for determining the precise location of an arrow embedded in a target in the first embodiment.
Figure 2A:
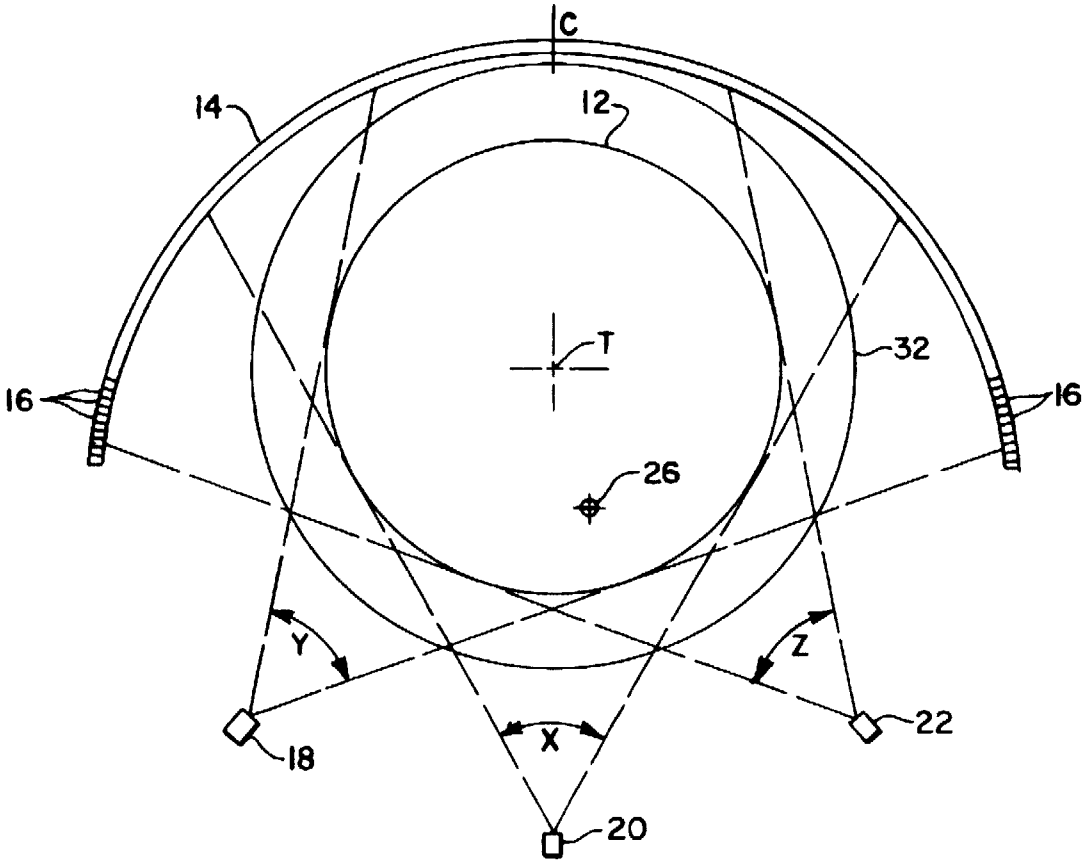
Figure 5:
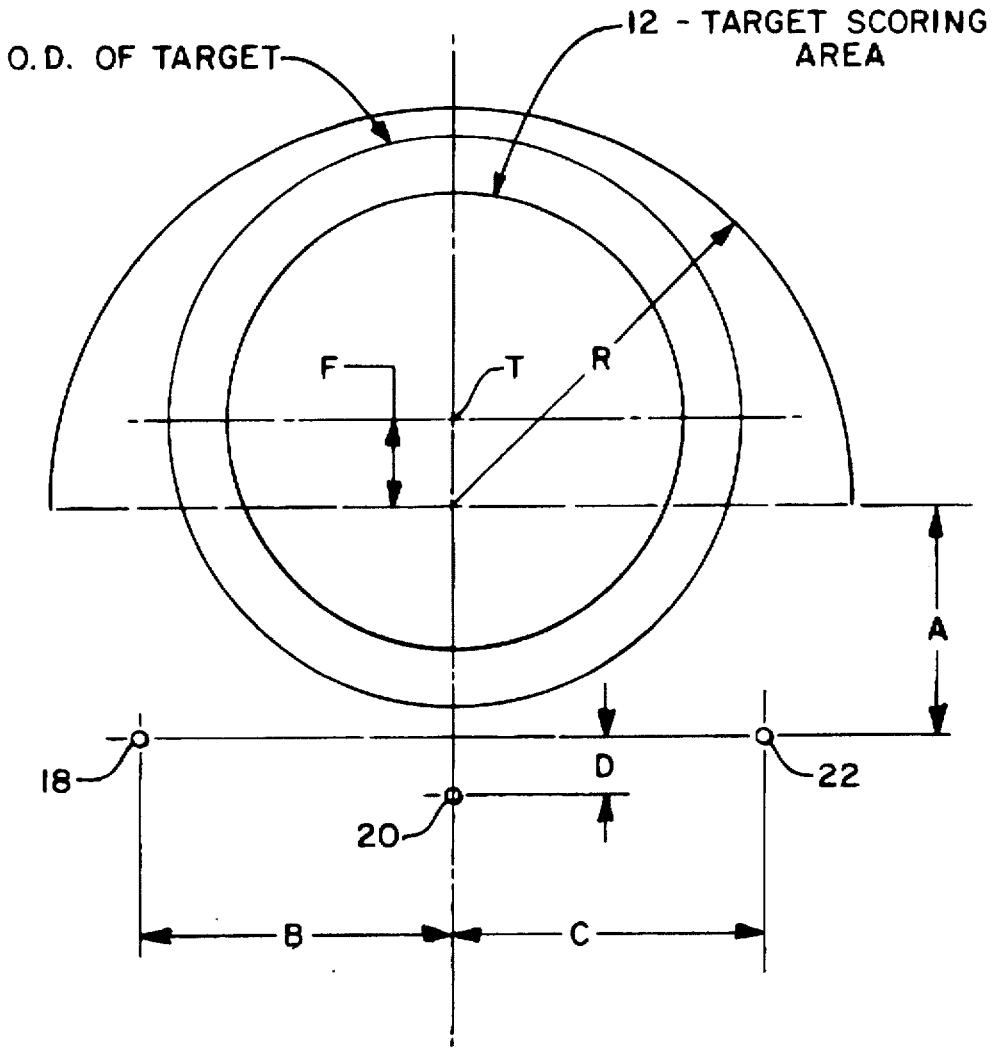
FIG. 5 is a diagrammatic view illustrating the geometric relationships.

An associated target 12 having a first center T is partially surrounded by an array 14 of a plurality of light sources 16 disposed in an arc 14 having a second center C. Referring to FIG. 5, there is shown an offset F of 2.375 inches from the first center T of the associated target 12 and the center C of the plurality of light sources 16. This offset is empirically derived. Each light sources 16 is a light emitting diodes (LED). Accordingly, the reference numeral 16 will be used for either an LED or a light source. Except for the LEDs at the ends of the arcuate array each LED is disposed in side abutting relation to two other LEDs in the arcuate array. The arcuate array 14 of the plurality of light sources has an angular sector of 177.6 degrees and a radius of 11.562 inches in the preferred embodiment. The number of LEDs 16 in the arcuate array 14 number 512. In the preferred embodiment the LEDs 16 are rectangular in shape with one side being the actual emitter, having an emitting azimuth range of approximately 120 degrees. Photo sensors 18, 20, 22 are arrayed outside target 12 and located opposite the plurality of light sources 16 so that photo sensors' 18, 20, 22 functional cone of operation's azimuth angles X, Y, and Z are approximately 60 degrees each and overlap to receive the beam of light 28 emitted from any one of the plurality of LEDs 16. This is illustrated in FIG. 2. The output power of each LED 16 is approximately 1.2 milliwatts.

Figure 3:
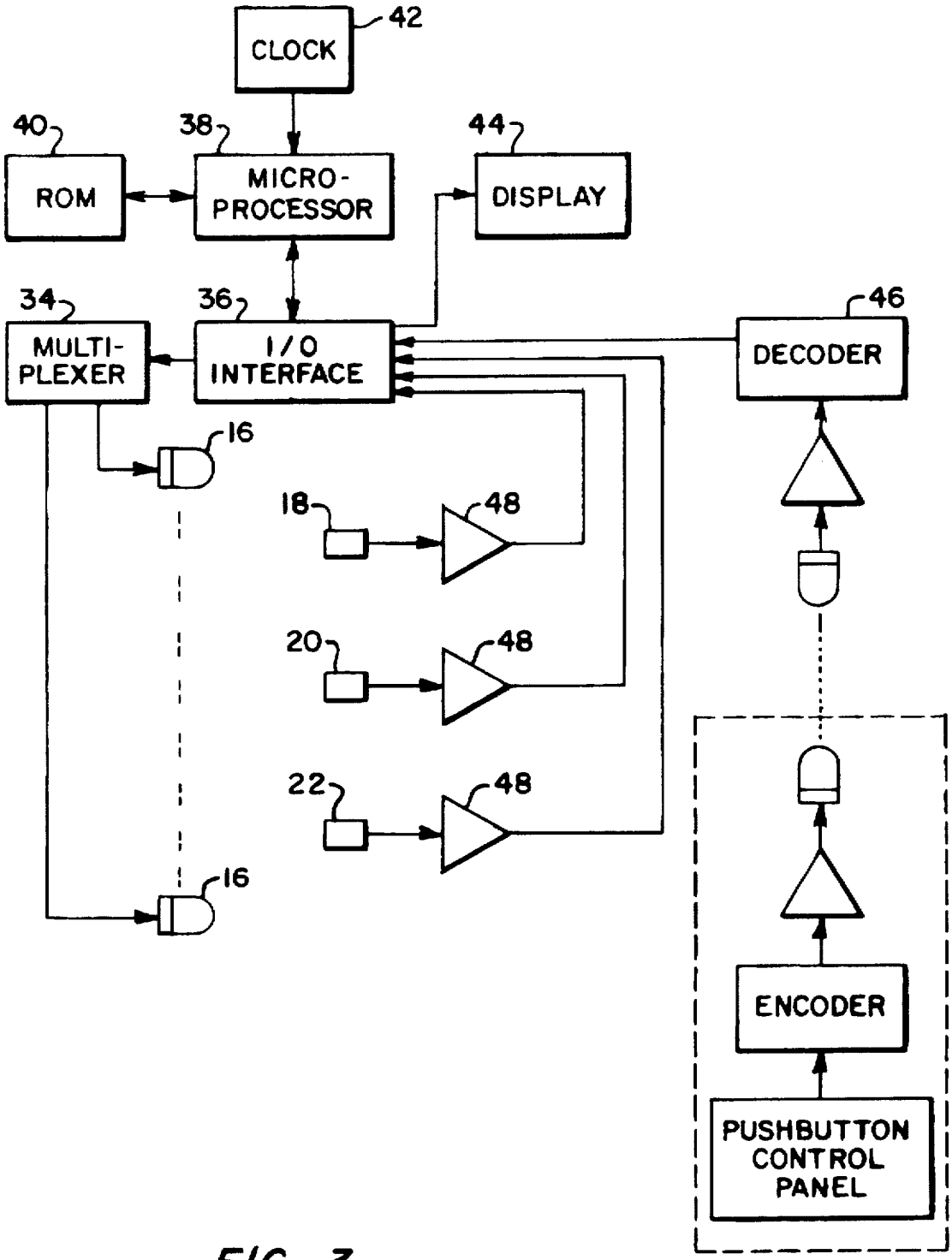
FIG. 3 is a block diagram of the apparatus in the first embodiment.

Each LED 16 is normally off, producing no light 28 output until a relatively high voltage pulse is applied to LED 16 producing a brief and intense pulse of light. The LEDs 16 are powered by multiplexer 34 and controlled by microprocessor 38 and are turned on in sequence such that only one LED 16 emanates a light beam 28 at any given time. The collective beams 28 produce a scan of the associated target 12. The light beam 28 is projected across the face of target 28 to either photo sensors 18, 20 or 22. Suitable light shields 24 may be provided to eliminate the effects from ambient light. With no associated arrow 26 present, photo sensor 18, 20, or 22 detects the light 28 output from the light source 16 and produces an output voltage. With an arrow 26 embedded in the target and interposed between the LED 16 and photo sensor 18, 20, or 22, the light beam 28 is interrupted, producing a change in the photo sensor's 18, 20 or 22 output voltage. The output voltage is fed into an amplifier circuit 48 which amplifies and shapes the voltage so as to be suitable for processing by the digital electronics circuitry of microprocessor 38 used for calculating and displaying scores. This is shown in FIGS. 2–3.

Figures 4A, 6:
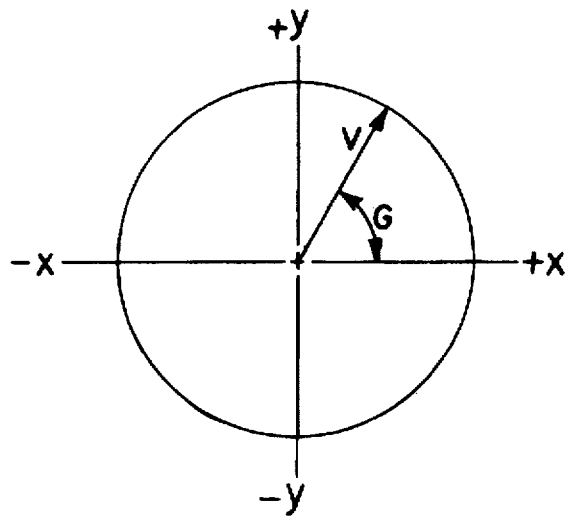

The position of each LED 16 is identified electronically in the microprocessor 38 such that when an identified LED 16 is momentarily turned on and light sensors 18, 20, or 22 receive no light pulse due to an interposing arrow 26, that arrow 26 can be precisely located using the mathematical definitions and relationships shown in FIGS. 4–5. These mathematical relationships provide X and Y rectangular coordinates in terms of identified LEDs 16 to locate each arrow 26. These coordinates are then translated to the symmetrical center T of target 12. This is demonstrated in FIGS. 5–6. The X and Y coordinates are then translated into polar coordinates which use the reference angles and line vectors according to the equations shown in FIG. 6. The polar coordinate system is appropriate and compatible with the pattern of scoring in the face of target 12. An example of this is the scoring of various dart games. The individual LED's 16 identification and photo sensors' 18, 20, and 22 output are used by the microprocessor circuits 38 which perform the mathematical functions, calculate the score according to game rules programmed into the Read Only Memory (ROM) 40 and display the score on display 44. FIG. 7 is a portion of a computer program listing which shows the mathematical calculations and FIG. 3 is a block diagram of the essential elements of this method.

Referring now to FIGS. 8–11 there is shown another preferred form of the detection apparatus 10 for precisely locating an associated arrow 26 in an associated target 12. The apparatus 10 includes an associated target 12, light detection and transmitting module 50, two mirrors 54 and 56, and a plurality of corner cube reflectors 52. The light detection and transmitting module 50 is made up of light source 14, photo sensor 18, a fixed half prism 58, lens 6 intermediate light source 14 and fixed half prism 58, lens 8 intermediate photo sensor 18 and fixed half prism 58, light shield 24, reflector 60 mounted on a motor's rotating shaft, and a motor 62. The apparatus is shown in greatest detail in FIGS. 8–10 and the means for precisely locating an arrow 26 in a target 12 is shown in FIGS. 6, 8, 12 and 13.

Figure 8:
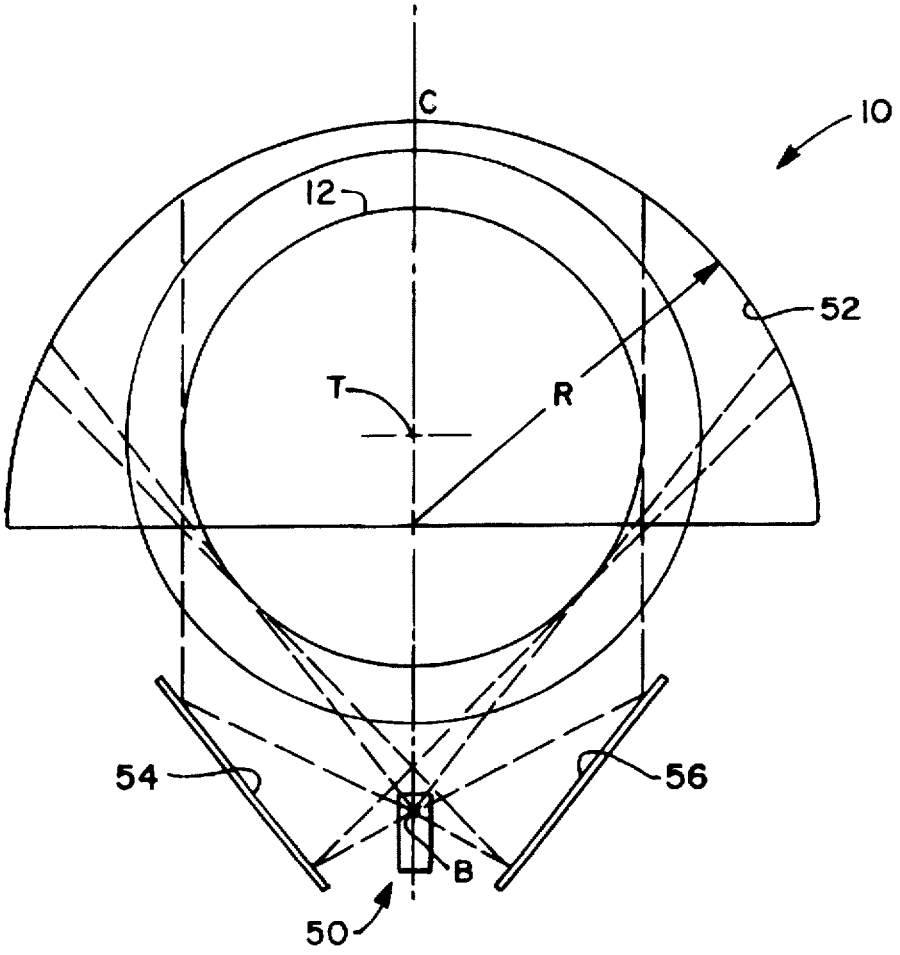
FIG. 8 is a top view showing the relationship of elements of the apparatus that is in accordance with the preferred form of the invention in a second embodiment.
Figure 9:
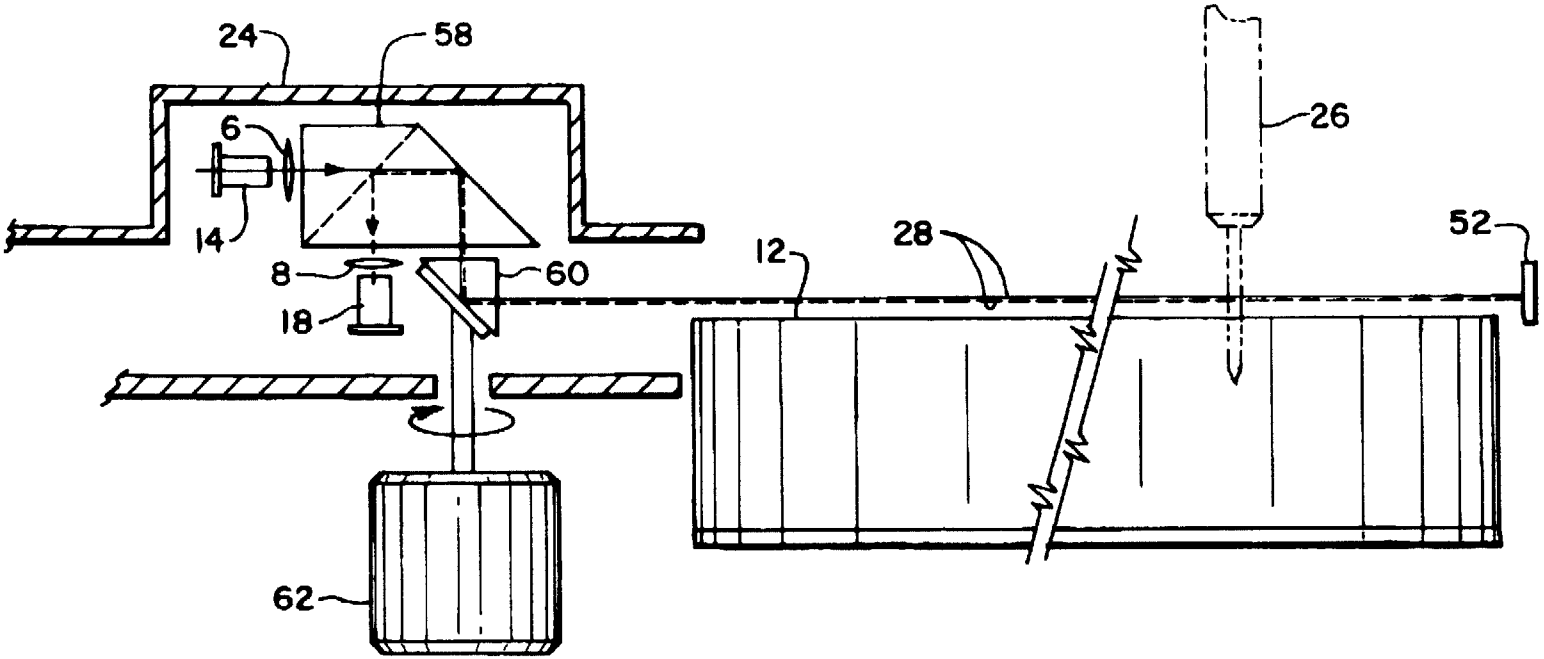
FIG. 9 is a partial side view of the elements of the light detection and transmitting module and the relationship of the light detection and transmitting module to an arrow and the plurality of corner cube reflectors in accordance with the second embodiment.

An associated target 12 having a first center T is partially surrounded by a plurality of corner cube reflectors 52 disposed having a second center C with the plurality of corner cube reflectors 52 being arrayed generally around a first side of target 12. Referring to FIG. 8, there is shown an offset of 2.375 inches from the first center T of associated target 12 and the second center C of the plurality of corner cube reflectors 52 which was empirically derived. The plurality of corner cube reflectors 52 has an angular sector of 177.6 degrees and a radius of 11.562 inches. The light detection and transmitting module 50 is disposed on a side of the associated target 12 which is generally opposite the plurality of corner cube reflectors 52. This is illustrated in detail in FIG. 8. The mirrors 54 and 56 are 6.25 inches long in the preferred embodiment and are positioned on either side of the light detection and transmitting module 50 in such a manner so that a beam of light 28 originating from the light detection and transmitting module 50 is reflected to the plurality of corner cube reflectors 52, producing a scan of the face of target 12. The light beam 28 is then reflected back along its original path, or a path closely parallel to it, through reflector 60, fixed half prism 58 and lens 8 to sensor 18. The light source 14 is a semi-conductor diode laser with a power rating of approximately 3 milliwatts. Microprocessor 38 generates a train of pulses, each one accurately timed and electronically identified, which alternately turn the laser 14 on and off, producing a series of pulses of light 28. Simultaneously the motor's 62 rotating shaft causes the light path to scan across the face of target 12. The motor's 62 rotation is synchronized with the laser 14 pulse train such that the light pulses, which are accurately generated, are closely and equally spaced in a radial pattern. This is shown in detail in FIG. 9.

Figure 10:
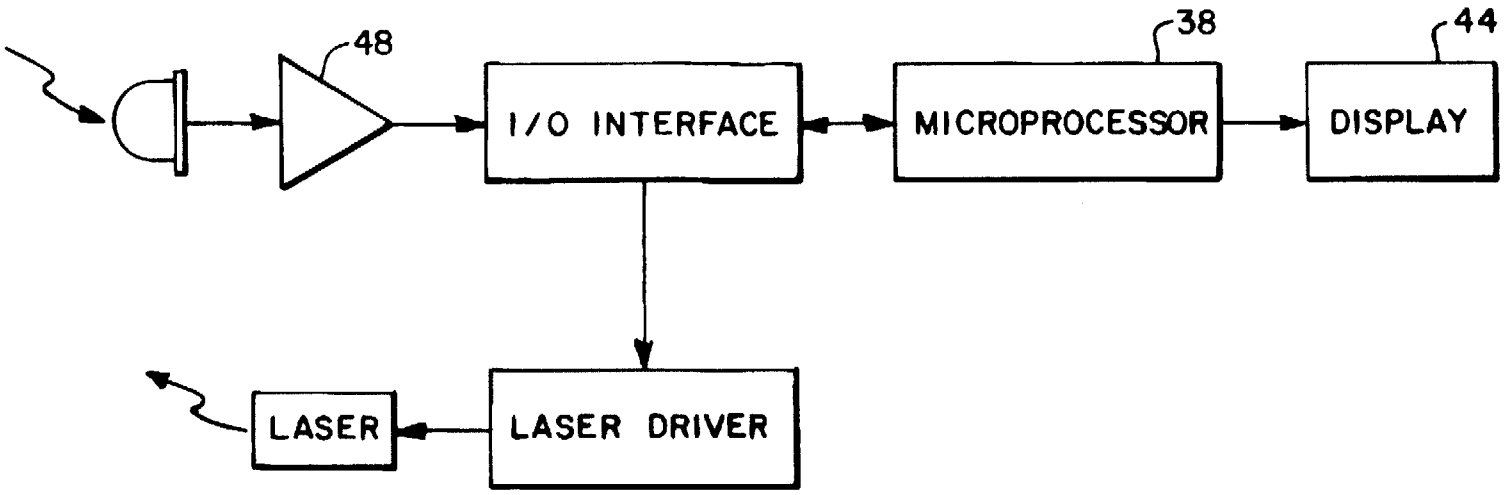
FIG. 10 is a block diagram of the elements of the preferred form of the invention in the second embodiment.
Figure 11:
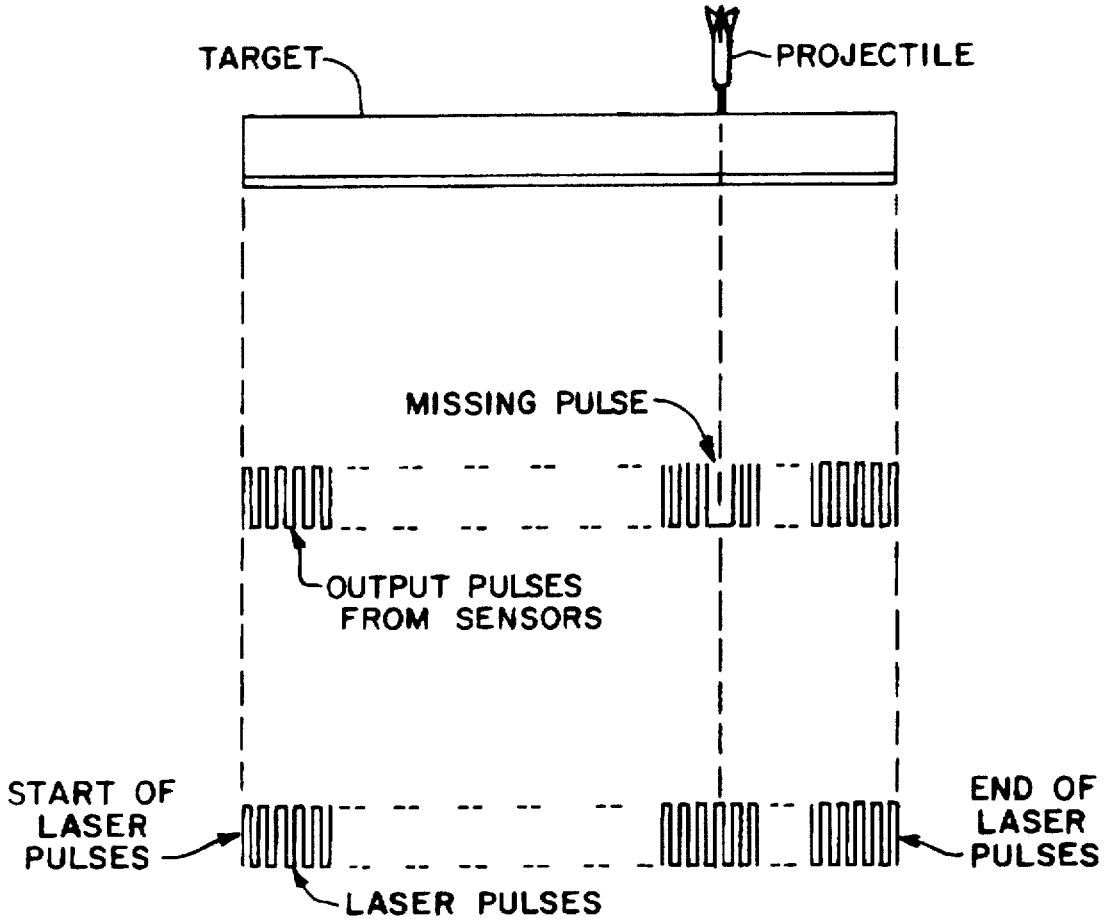
FIG. 11 is a diagram of the rectangular pulses emitted from the light detection and transmitting module and demonstrate how an arrow interferes with the laser pulses in the second embodiment.

The photo sensor's 18 output waveform is in the form of a repetitious rectangular wave. Where light is blocked by an associated arrow 26 embedded in an associated target 12, notches appear in the output waveform. The notches indicate missing pulses from the waveform. This is shown in FIG. 11. The missing pulses and remaining waveform are processed by digital circuits to produce location coordinates for each arrow 28. The output signals are then sent to microprocessor 38 which performs the mathematical functions shown in FIGS. 6 and 13 and then displays the score on display 44 by using the mathematical definitions and relationships shown in FIGS. 5, 6 and 13. These mathematical relationships provide X and Y rectangular coordinates in terms of identified notches in the rectangular waveform to locate each associated arrow 26. These coordinates are then translated to the symmetrical center T of target 12. This is demonstrated in FIGS. 5–6. The X and Y coordinates are then translated into polar coordinates which use the reference angles and line vectors according to the equations shown in FIG. 6. The polar coordinate system is appropriate and compatible with the pattern of scoring in the face of target 12. An example of this is the scoring of various dart games. FIG. 12 is a portion of a computer program listing which shows the mathematical calculations and FIG. 10 is a block diagram of the essential elements of this method.

It will be understood that the dimensions provided are to accommodate an associated target 12 having a diameter of 18 inches. The same principles described herein can be used for an associated target 12 of any diameter. The apparatus will thus be seen to work with an unmodified bristle board and other targets off the shelf and do not require any special requirements as do other systems.

The invention has been described with reference to its illustrated preferred embodiment. Persons skilled in the art of such devices may upon exposure to teachings herein, conceive other variations. Such variations are deemed to be encompassing by the disclosure, the invention being delimited only by the following claims.

Having thus described my invention I claim:

1. An apparatus for precisely locating an associated arrow embedded in an associated unmodified standard board target having a first center which includes:

a plurality of light sources disposed in an arc having a second center;

a plurality of photo sensors arrayed opposite said light sources with the target intermediate said light sources and said photo sensors;

means for turning on and off said light sources sequentially to produce a scan of the target;

means for detecting when an arrow embedded in the target interrupts any light beam from any of said light sources to any of said photo sensors; and means for determining the exact location of the arrow embedded in the target, said means for determining utilizing said means for detecting.

2. The apparatus as described in claim 1 wherein:

said plurality of photo sensors comprises three photo sensors.

3. The apparatus as described in claim 1 wherein:

said means for determining the arrow's location includes a multiplexer and said multiplexer controls the scan of said light sources.

4. The apparatus as described in claim 3 wherein:

said multiplexer is controlled by a microprocessor which turns the said light sources on in sequence so that only one said light source's light is projected across the target to said photo sensors.

5. The apparatus as described in claim 4 wherein:

said photo sensors are located in relation to the target and said light sources so that said photo sensors' cones of operation have azimuth angles of approximately 60 degrees each and said azimuth angles overlap in order to receive the beam of light from any said light source.

6. The apparatus as described in claim 5 wherein:

said light sources are light emitting diodes (LEDs).

7. The apparatus as described in claim 6 wherein:

the number of said LEDs in said arcuate array is 512.

8. The apparatus as described in claim 7 wherein:

said photo sensors and said plurality of LEDs are covered by a light shield.

9. The apparatus as described in claim 8 wherein:

said arcuate array of said plurality of light sources has an angular sector of 177.6 degrees.

10. The apparatus as described in claim 9, wherein:

said arcuate array of said light sources has a radius of 11.562 inches.

11. The apparatus as described in claim 1 in which:

said microprocessor receives the output signal from said photo sensors and performs the required mathematical functions to calculate the location coordinates.

12. The apparatus as described in claim 11 wherein:

said microprocessor is connected to a Read Only Memory (ROM), in which the rules of the game being played can be programmed, and the score calculated according to the game rules programmed into said ROM.

13. The apparatus as described in claim 12 wherein:

said apparatus further includes a display and said microprocessor displays the score of the game being played on said display.

* * * * *